US009945313B2

(12) United States Patent
Kotwicki et al.

(10) Patent No.: US 9,945,313 B2
(45) Date of Patent: Apr. 17, 2018

(54) MANIFOLD PRESSURE AND AIR CHARGE MODEL

(71) Applicant: Tula Technology, Inc., San Jose, CA (US)

(72) Inventors: Allan J. Kotwicki, Williamsburg, MI (US); Joel D. Van Ess, Campbell, CA (US)

(73) Assignee: Tula Technology, Inc., San Jose, CA (US)

( * ) Notice: Subject to any disclaimer, the term of this patent is extended or adjusted under 35 U.S.C. 154(b) by 335 days.

(21) Appl. No.: 13/794,157

(22) Filed: Mar. 11, 2013

(65) Prior Publication Data

US 2014/0251282 A1 Sep. 11, 2014

(51) Int. Cl.

| | |
|---|---|
| ***F02D 7/00*** | (2006.01) |
| ***F02D 41/18*** | (2006.01) |
| *F02D 35/02* | (2006.01) |

(52) U.S. Cl.

CPC ..... *F02D 41/18* (2013.01); *F02D 35/028* (2013.01); *F02D 2200/0402* (2013.01); *F02D 2200/0408* (2013.01)

(58) Field of Classification Search

USPC ..... 123/434, 445, 472, 478, 481

See application file for complete search history.

(56) References Cited

U.S. PATENT DOCUMENTS 4,434,767 A 3/1984 Kohama et al.
4,489,695 A 12/1984 Kohama et al.
4,509,488 A 4/1985 Forster et al.
5,377,631 A 1/1995 Schechter
5,497,329 A 5/1996 Tang
5,947,095 A 9/1999 Kato
6,138,504 A * 10/2000 Lewis ..... F02D 41/0072 73/114.33
6,158,411 A 12/2000 Morikawa
6,363,316 B1 3/2002 Soliman et al.
6,609,058 B1 * 8/2003 Russell ..... F02D 41/0072 123/568.11
6,619,258 B2 9/2003 McKay et al.
6,634,328 B2 10/2003 Russell et al.
6,636,796 B2 10/2003 Kolmanovsky et al.
6,718,822 B2 4/2004 Soliman et al.
(Continued)

OTHER PUBLICATIONS

Speed Density SD vs. Mass Air Flow MAF, PCM for Less, Downloaded Mar. 11, 2013, http://www.pcmforless.com/index.php?option=com_content&view=article&id=126:speed-density-sd-vs-mass-air-flow-maf-&catid=34:tuning&Itemid=56.
(Continued)

*Primary Examiner* — Lindsay Low
*Assistant Examiner* — Ruben Picon-Feliciano
(74) *Attorney, Agent, or Firm* — Beyer Law Group LLP

(57) ABSTRACT

In one aspect, an engine controller for an engine including multiple working chambers is described. The engine controller includes a mass air charge determining unit that estimates a mass air charge or amount of air to be delivered to a working chamber. Firing decisions made for a firing window of one or more firing opportunities are used to help determine the mass air charge. The engine controller also includes a firing controller, which is arranged to direct firings to deliver a desired output. Fuel is delivered to a working chamber based on the estimated mass air charge.

21 Claims, 4 Drawing Sheets

(56) References Cited

U.S. PATENT DOCUMENTS

| | | | |
|---|---|---|---|
| 6,760,656 | B2 | 7/2004 | Matthews et al. |
| 6,805,095 | B2 | 10/2004 | Sun et al. |
| 6,850,831 | B2 | 2/2005 | Buckland et al. |
| 7,032,581 | B2 | 4/2006 | Gibson et al. |
| 7,063,062 | B2 | 6/2006 | Lewis et al. |
| 7,066,136 | B2 | 6/2006 | Ogiso |
| 7,085,647 | B1 | 8/2006 | Prucka et al. |
| 7,086,386 | B2 | 8/2006 | Doering |
| 7,151,994 | B2 | 12/2006 | Fuwa |
| 7,275,511 | B1 | 10/2007 | Wright et al. |
| 7,464,674 | B2 | 12/2008 | Michelini et al. |
| 7,503,312 | B2 | 3/2009 | Surnilla et al. |
| 7,577,511 | B1 | 8/2009 | Tripathi et al. |
| 7,849,835 | B2 | 12/2010 | Tripathi et al. |
| 7,886,715 | B2 | 2/2011 | Tripathi et al. |
| 7,899,607 | B2 | 3/2011 | Shin et al. |
| 7,921,709 | B2 | 4/2011 | Doering et al. |
| 7,930,087 | B2 | 4/2011 | Gibson et al. |
| 7,954,474 | B2 | 6/2011 | Tripathi et al. |
| 8,099,224 | B2 | 1/2012 | Tripathi et al. |
| 8,131,445 | B2 | 3/2012 | Tripathi et al. |
| 8,131,447 | B2 | 3/2012 | Tripathi et al. |
| 8,251,044 | B2 | 8/2012 | Russell et al. |
| 8,651,091 | B2 | 2/2014 | Tripathi et al. |
| 9,086,020 | B2 | 7/2015 | Pirjaberi et al. |
| 9,399,964 | B2 | 7/2016 | Younkins et al. |
| 2002/0096134 | A1 | 7/2002 | Michelini et al. |
| 2002/0133286 | A1 | 9/2002 | Kolmanovsky et al. |
| 2003/0220732 | A1 | 11/2003 | Matthews et al. |
| 2006/0243255 | A1* | 11/2006 | Ma ..... F02D 41/062 123/491 |
| 2010/0050993 | A1 | 3/2010 | Zhao et al. |
| 2011/0208405 | A1* | 8/2011 | Tripathi ..... F02D 17/02 701/102 |
| 2011/0213540 | A1 | 9/2011 | Tripathi et al. |
| 2011/0251773 | A1 | 10/2011 | Sahandiesfanjani et al. |
| 2012/0143471 | A1 | 6/2012 | Tripathi et al. |
| 2012/0191316 | A1 | 7/2012 | Leone et al. |
| 2014/0069374 | A1 | 3/2014 | Matthews |
| 2014/0069375 | A1 | 3/2014 | Matthews et al. |
| 2014/0069376 | A1 | 3/2014 | Matthews et al. |
| 2014/0069377 | A1 | 3/2014 | Brennan et al. |
| 2016/0377007 | A9 | 12/2016 | Wilcutts et al. |

OTHER PUBLICATIONS

International Search Report dated Jun. 25, 2014 from International Application No. PCT/US2014/018745.
Tripathi et al, U.S. Appl. No. 15/401,516, filed Jan. 9, 2017.
Kotwicki et al., U.S. Appl. No. 15/628,309, filed Jun. 20, 2017.
Pirjaberi et al., U.S. Appl. No. 15/679,419, filed Aug. 17, 2017.

* cited by examiner

MANIFOLD PRESSURE AND AIR CHARGE MODEL

FIELD OF THE INVENTION

The present invention relates generally to methods and mechanisms for estimating manifold air pressure and/or mass air charge. Various embodiments involve using such estimates to help improve engine performance, particularly in variable displacement or skip fire applications.

BACKGROUND

Most vehicles in operation today are powered by internal combustion (IC) engines. Internal combustion engines typically have multiple cylinders or other working chambers where combustion occurs. The power generated by the engine depends on the amount of fuel and air that is delivered to each working chamber. The mass of air delivered into each working chamber per intake event is referred to as the mass air charge.

Air is typically delivered into the working chamber from an intake manifold. A throttle valve helps regulate the delivery of air from the outside environment into the intake manifold. Opening the throttle causes more air to enter the intake manifold, which tends to increase the manifold absolute pressure. Higher manifold absolute pressure causes more air to enter the working chamber which when combusted with fuel generates greater torque and power.

It is important to accurately estimate the mass air charge. Generally, fuel is delivered to the working chamber in proportion to the mass air charge estimate. If the mass air charge estimate is inaccurate, there may be improper combustion. This can result in poor performance and the generation of undesirable pollutants in the exhaust of the vehicle.

There are several ways to determine the mass air charge. One approach uses a mass air flow sensor. The mass air flow sensor, which is typically located in a line between the air cleaner and the throttle, measures the mass of air flowing into the intake manifold which is used to estimate the mass air charge. A drawback of using the air meter directly is that depending on how the estimate is done there can be either no direct relation or a time delay between the measured mass air and when air is inducted into a cylinder. This may cause the estimated cylinder air mass charge to differ from the actual value, especially during transient conditions.

Another approach is commonly referred to as a speed density system. In this approach, the mass air charge is calculated based on engine speed, inlet air temperature, and manifold absolute pressure (MAP) which is typically measured directly using a suitable sensor in the intake manifold.

There are a number of patent documents and other publications that discuss additional techniques for estimating mass air charge. For example, U.S. Pat. No. 6,760,656 (hereinafter referred to as the '656 patent) relates to a method for estimating cylinder air charge for a variable displacement engine that shifts between two modes of operation, one in which all the cylinders are fired and another in which half the available cylinders are fired. The cylinder air charge estimate is based on data provided by a manifold absolute pressure sensor, which directly measures manifold pressure and a throttle position sensor.

SUMMARY OF THE INVENTION

A variety of methods and arrangements for estimating mass air charge for an internal combustion engine are described. In one aspect, an engine controller for an engine including multiple working chambers is described. The engine controller includes a mass air charge determining unit that estimates a mass air charge or amount of air to be delivered to a working chamber. In various embodiments, firing decisions made for an interval of one or more firing opportunities are tracked and used to determine a firing frequency. The firing frequency is any suitable value or data that helps indicate a ratio of the number of firing events to the total number of firing opportunities in the interval. The firing frequency is used to help determine the mass air charge. The engine controller also includes a firing controller, which is arranged to direct firings to deliver a desired output. Fuel is delivered to a working chamber based on the estimated mass air charge.

In various embodiments, the mass air charge determining unit estimates the manifold absolute pressure (MAP). This estimated manifold absolute pressure is then used to predict the mass air charge. MAP can be determined from a mass air flow sensor and a firing frequency. As a result, in some implementations the estimation of the mass air charge does not involve or require the use of MAP sensor data, although in other implementations the MAP sensor may still be used. The estimated MAP can be used for other powertrain, engine, and diagnostic applications. The above approaches may be applied to many types of engine control methods and algorithms. For example, various designs are well suited to mass air charge estimation in variable displacement engines, where a predetermined set of working chambers are deactivated while other working chambers are fired. Such designs work particularly well for engines employing dynamic skip fire control. In this type of engine control multiple individually controlled working chambers may be fired or skipped so as to meet the engine load requirements. This type of engine control may result in a complex and rapidly varying pressure waves forming in the intake manifold as a result of the irregular opening and closing of the intake valves, which makes direct measurement of the MAP extremely difficult. Despite this variation an estimated MAP may be accurately modeled using the methods described herein.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

The present invention relates generally to models for estimating mass air charge and/or manifold absolute pressure for a wide variety of powertrain, engine and diagnostic applications. Such models can be particularly useful in skip fire and variable displacement engine control.

Various conventional approaches for estimating mass air charge rely on the direct measurement of the pressure in the intake manifold. This approach works well in situations in which the manifold absolute pressure does not frequently change. However, in some applications such as dynamic skip fire engine operation, air is not steadily and predictably withdrawn from the intake manifold into the working chambers of the engine for combustion. Working chambers may be individually controlled and decisions to "skip" (i.e., deactivate) or fire individual working chambers may be made in real time. Under such circumstances, the manifold absolute pressure may fluctuate in an unpredictable manner due to variable pressure waves from the irregular opening and closing of the intake valves. Such fluctuation can make it difficult to accurately estimate the mass air charge using methods or models that depend on direct measurements of the pressure in the intake manifold. Although this problem can be somewhat addressed by filtering the measured manifold pressure, filtering the manifold pressure measurement to remove the rapid fluctuations tends to cause an undesirable delay, which in turn can cause a lag in fueling and negatively affect engine performance.

Intake manifold filling and emptying cannot occur instantaneously, but is governed by time constants determined by engine design and operating speed. The nature of the manifold filling and emptying thus act effectively as a low pass filter, precluding high frequency changes in MAP. In particular, manifold emptying occurs during an intake stroke associated with a firing event. The firing frequency thus limits the frequency of MAP variations. For example, a 4-stroke engine operating on 8 cylinders at 1500 rpm has a firing frequency of 100 Hz. Obviously the firing frequency can vary widely depending on the type of engine, operating speed, control method, and number of cylinders. However, independent of its absolute value, the firing frequency limits the speed of MAP evolution.

Figure 1:
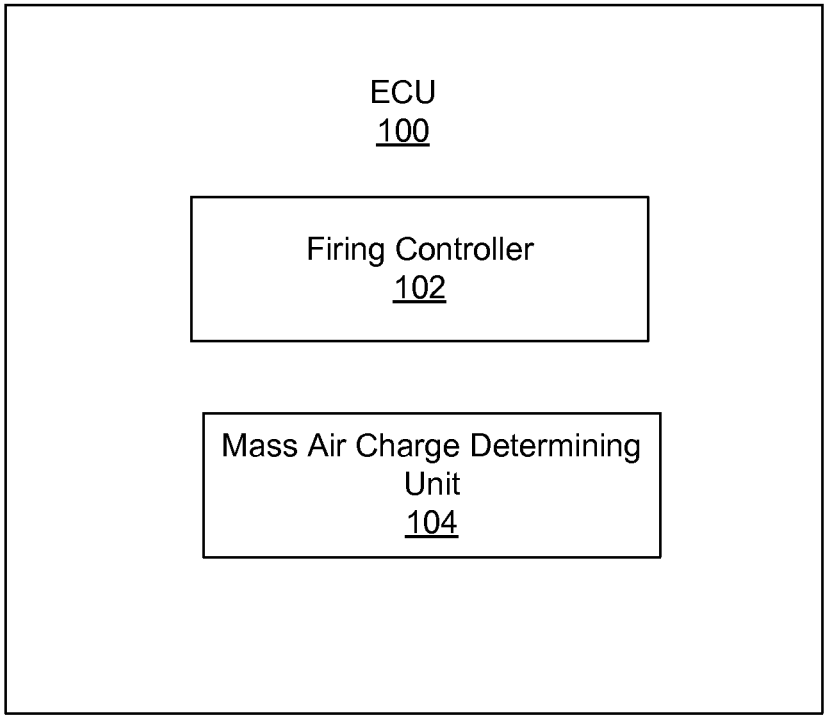
FIG. 1 is a block diagram of an engine control unit with a mass air charge determining unit according to one embodiment of the present invention.

Various implementations of the present invention address one or more of the above concerns. Referring initially to FIG. 1, an engine controller or engine control unit (ECU) 100 according to a particular embodiment of the present invention will be described. The ECU 100, which is arranged to orchestrate the firings of the engine (not shown), includes a firing controller 102 and a mass air charge determining unit 104.

The mass air charge determining unit 104 is arranged to calculate the mass air charge, which is then used to determine an amount of fuel to deliver to a working chamber for combustion. Unlike some conventional approaches, the mass air charge determining unit does not necessarily depend on input from a manifold absolute pressure sensor or mass air flow sensor. Various implementations estimate the manifold absolute pressure based on an interval or number of prior firing opportunities. The manifold absolute pressure is estimated by determining the air that flows into the intake manifold (e.g., using a mass air flow sensor) and the air that flows out during this interval (scaled by charge temperature) by being inducted by working chambers. The latter calculation involves obtaining air flow data during an interval or window of one or more firing opportunities and the operation of the corresponding working chambers. In various embodiments, when a working chamber is to be fired, it is assumed an air "pulse" is drawn into the chamber from the intake manifold, which contributes to a decline in the manifold absolute pressure. When a working chamber is skipped, it is assumed that the corresponding air "pulse" is instead retained in the intake manifold, causing a rise in the manifold absolute pressure. (In other embodiments, it may be assumed that some air is nevertheless delivered into the working chamber.) By jointly taking into account the air flowing into the manifold together with the operation of the individual working chambers, the manifold absolute pressure can be estimated. The estimated manifold absolute pressure is then used as one of several inputs to help determine the mass air charge. As a result, the mass air charge can be estimated even for applications in which the patterns of skips and fires are somewhat irregular or unpredictable, as can be the case with skip fire engine operation.

The ECU 100 also includes a firing controller 102. The firing controller 102 generates a firing sequence suitable for delivering a desired output. Any suitable firing controller may be used. In various embodiments, the ECU 100 is arranged to operate the engine in a variable displacement mode or in a skip fire manner. The assignee of the present application has filed multiple patent applications on a wide variety of skip fire and other engine designs, such as U.S. Pat. Nos. 7,954,474; 7,886,715; 7,849,835; 7,577,511; 8,099,224; 8,131,445; and 8,131,447; U.S. patent application Ser. Nos. 13/004,839 and 13/004,844; and U.S. Provisional Patent Application Nos. 61/639,500; 61/672,144; 61/441,765; 61/682,065; 61/677,888; 61/683,553; 61/682,151; 61/682,553; 61/682,135; 61/682,168; 61/080,192; 61/104,222; and 61/640,646, each of which is incorporated herein by reference in its entirety for all purposes. Many of the aforementioned applications describe firing controllers, firing fraction calculators, filters, power train parameter adjusting modules, firing timing determining modules, and other mechanisms that may be integrated into or connected with the ECU 100.

Figure 2:
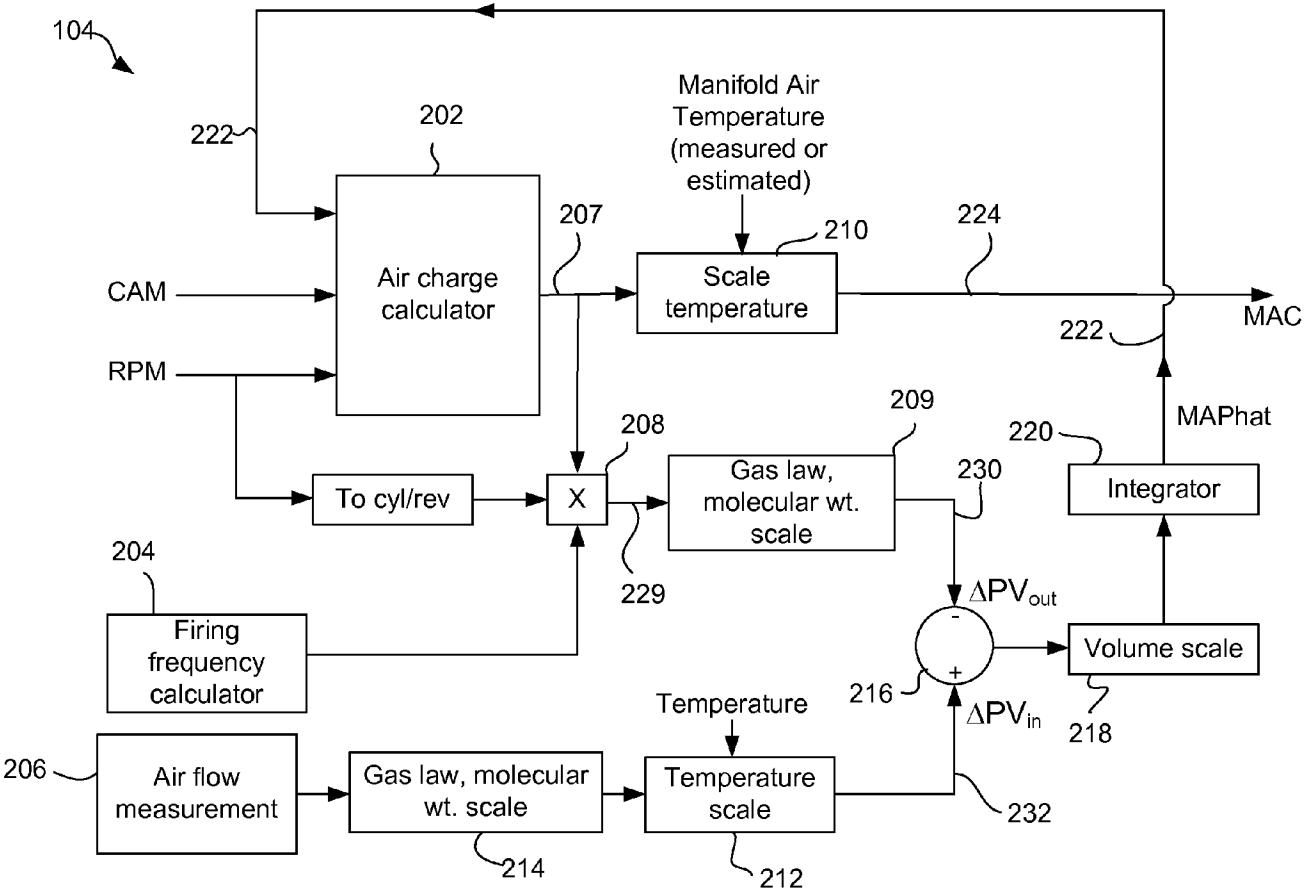
FIG. 2 is a simplified diagram of a mass air charge determining unit according to one embodiment of the present invention.

Referring next to FIG. 2, the mass air charge determining unit 104 of FIG. 1 according to one embodiment of the present invention will be described. The mass air charge determining unit 104 includes an air charge calculator 202, a firing frequency calculator 204 and an air flow measurement unit 206. The air charge calculator 202 may be a set of look up tables that determines the amount of air charge per working chamber or cylinder. The look up tables may be normalized for a certain air temperature, such as 0 C or equivalently 273.15 K. In this embodiment input is received at the air charge calculator 202 from a cam position sensor (CAM), which measures the cam phase relative to the crankshaft, and an engine speed sensor (RPM). Additional input to the air charge calculator 202 may include other engine operating configuration information needed to capture nominal engine air mass charge behavior. This input (not shown in FIG. 2) may include valve lift, exhaust system modifications, changes in induction with coolant temperature during warm-up, variable exhaust pressure due to turbochargers, etc.). The air charge calculator also receives an estimated MAP 222. The estimated MAP 222 is determined by other parts of the mass air charge determining unit 104 as described below.

In the embodiment described, cam position regulates the timing of the opening and closing of the valves that control the passage of air from the intake manifold into the working chambers. Engine speed affects how long the valves are kept open. Because higher flow velocity is needed at higher speeds to fill the chamber, engine speed can affect the mass air charge. The higher the pressure in the intake manifold, which is predicted using the estimated MAP 222, the more air is delivered from the intake manifold into a working chamber when the corresponding intake valve opens. Based on these inputs, the air charge calculator 202 determines an estimated air charge 207, which is scaled based on the measured or estimated temperature (block 210) to determine an estimated Mass Air Charge MAC 224. The MAC value may be used by the ECU (not shown in FIG. 2) to determine the appropriate amount of fuel for the cylinder firing. The estimated air charge is outputted to a multiplier 208 where it provides a signal that helps to determine an estimated MAP value.

The firing frequency calculator 204 is arranged to determine the percentage or fraction of firings under current (or directed) operating conditions in a given firing window of one or more firing opportunities. The firing window may be chosen so that it equals the number of engine cylinders, although larger or smaller firing windows may be used. The window may capture the recent firing history or it may be phased so that future firing decisions are included in the window. The firing frequency may be determined in any suitable manner. In some embodiments, for example, the firing frequency is simply determined by dividing the number of firing events in the firing window by the number of firing opportunities in the window. A greater number of firings relative to a specific mass air flow at steady state contributes to a decrease in the manifold pressure, which in turn tends to decrease the mass air charge. In a particular embodiment, a number of consecutive firing opportunities are examined and the number of active firing events is taken into account to determine the firing frequency. The calculated firing frequency is then output to multiplier 208. The output of the multiplier 208 is signal 229, which is based on multiplying inputs from the firing frequency calculator 204, engine speed sensor (using a scaled value), and the air charge calculator 202. Signal 229 is then multiplied by the universal gas constant and divided by molecular weight of air at 209. The result is signal 230 which reflects the change in the pressure volume product $\Delta PV_{out}$ due to the amount of air inducted by the engine. Signal 230 is then sent to adder 216 where it helps determine the estimated MAP.

The air flow measurement unit 206 determines the mass flow rate at which air is flowing into the intake manifold. A higher air flow rate relative to a specific firing frequency at steady state contributes to an increase in the manifold pressure, which in turn tends to increase the mass air charge. In many implementations, air flow measurement is based on input received from a mass air flow sensor situated upstream of the throttle on a line between the throttle and the intake manifold. The mass air flow measurement is scaled based on temperature, the molecular weight of air and the gas constant (blocks 212 and 214) to determine a signal level 232 that represents an effective product of pressure and volume being input into the intake manifold, $\Delta PV_{in}$. The signal 232 is then received at the adder 216.

Adder 216 receives two inputs. The first input 230 is based on signal 229 from the multiplier 208 which is converted by scaling unit 209. Signal 229 is in turn based on the firing frequency calculator output 204, the engine speed, and the air charge calculator 202. The second input 232 is based on output from the air flow measurement unit 206. The adder 216 subtracts the first input 230 from the second input 232. The result change in the PV product is scaled based on the volume of the intake manifold and integrated over time (blocks 218 and 220) to determine an estimated manifold absolute pressure 222 (MAPhat.).

The estimated manifold absolute pressure 222 is received as an input to the air charge calculator 202 through a feedback loop. Based on the estimated MAP, cam position and engine speed, the air charge calculator 202 generates an output that is scaled based on temperature (block 210) to be an estimated mass air charge 224. The estimated mass air charge 224 is used to determine the amount of fuel to deliver to a working chamber.

It should be appreciated that the present invention is not limited to what is shown in the drawing, and that the illustrated embodiment can be modified to include a wide variety of operations, functional blocks, and mechanisms. For example, the illustrated embodiment contemplates that a skip of a working chamber tends to leave more air in the intake manifold and therefore increases the manifold absolute pressure. However, the design may be modified to address an engine operation in which air is delivered even to working chambers that will be deactivated or skipped, thus contributing to a decline in the manifold absolute pressure. In other implementations, the mass air charge determining unit 104 takes into account the MAP effects of an exhaust gas recirculation (EGR) system or air that is released back into the intake manifold from a working chamber. Generally, the described embodiment can be modified as appropriate to address any factor that might substantially impact the manifold absolute pressure or mass air charge.

In many preferred implementations, the illustrated components estimate the manifold absolute pressure and/or the mass air charge on a working cycle by working cycle basis. Although many implementations make a MAP or MAC estimate at each firing opportunity, in other implementations it is desirable to make such estimations less frequently.

Figure 3:
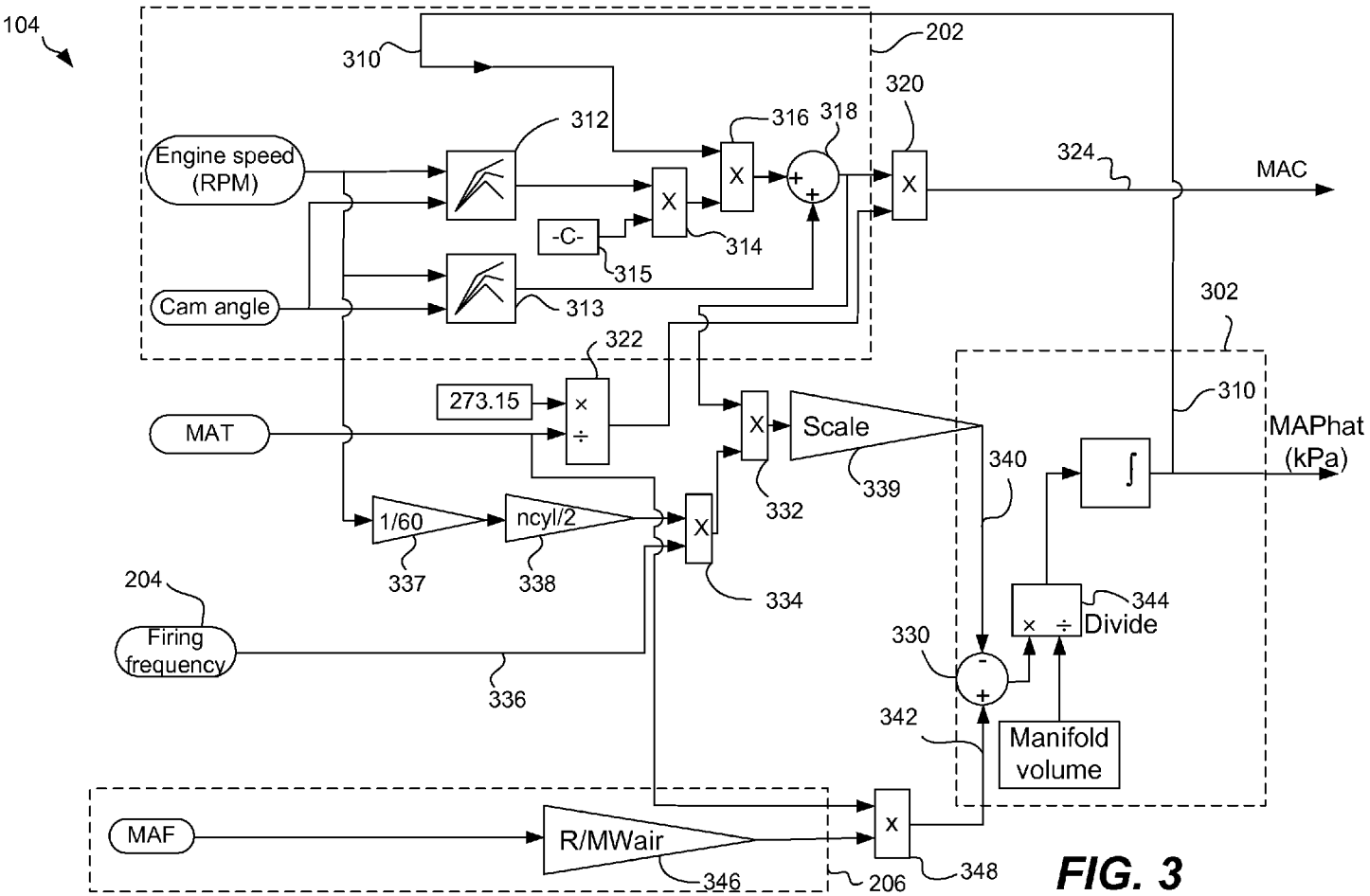
FIG. 3 is a more detailed diagram of a mass air charge determining unit according to one embodiment of the present invention.

Referring next to FIG. 3, a mass air charge determining unit 104 according to a particular embodiment of the present invention will be described. The mass air charge determining unit 104 includes an air charge calculator 202, a firing frequency calculator 204, an air flow measurement unit 206, and a MAP estimation unit 302. Generally, the mass air charge determining unit 104 functions similarly to the one illustrated in FIG. 2, although it includes additional details. It should be appreciated, however, that FIG. 3 is intended to describe only a single example implementation and may be modified to suit a variety of different applications.

In this example, the air charge calculator 202 receives inputs from an engine speed sensor (in RPM), a cam position sensor (in degrees) and a mass air temperature (MAT) sensor or estimator (in Kelvin). The air charge calculator 202 receives an estimated MAP 310 through a feedback loop.

The air charge calculator 202 includes slope lookup module 312 and offset lookup module 313, which each receive input from the engine speed sensor and the cam position sensor to account for the variation of engine air induction behavior with different cam timing and at different engine speeds. The slope and offset lookup modules 312/313 represent a model that relates the mass air charge to the engine speed cam position, and manifold pressure. The information may be stored normalized to a standard intake temperature, in this example 273.15 degrees Kelvin. In some embodiments, this model can be understood as a linear curve with a vertical mass offset value and a slope value that is the rate of increase of mass air charge with manifold pressure. The slope and offset values may be determined using any suitable mechanism, such as one or more lookup tables. The slope value may scaled by a factor C 315 at the multiplier 314. The scale factor C may be empirically determined and may compensate for various engine parameters, such as engine wear. The output of the multiplier 314 is then received at another multiplier 316, which receives a MAP input (e.g., the estimated MAP 310) from the MAP estimation unit 302. The output of the multiplier 316 is received at the adder 318. The adder 318 also receives the offset value from the offset lookup module 313. The sum of the inputs at the adder 318 is output to the multiplier 320. Alternatively, the air charge calculator 202 may use mathematical relations, such as polynomial equations, multi dimensional look up tables or any other method to determine a temperature normalized mass air charge.

The multiplier 320 also receives input from the manifold air temperature (MAT) sensor or estimation. The output of the MAT is scaled at block 322. In this case the temperature is normalized to 0 C (273.15 K) corresponding to the temperature used to normalize the information used in block 202 although any temperature can be chosen as the normalization point. The output of the block 322 is sent to the multiplier 320. The output of the multiplier 320, which receives inputs from the air charge estimation unit 202 and the MAT, is the estimated mass air charge 324 (in grams per working chamber cycle).

The MAP estimation unit 302, which is used to help determine the above estimated mass air charge 324, receives input through an adder 330. The adder 330 receives first and second inputs 340/342. The first input 340 is based on outputs from the air charge calculator 202, and the firing frequency calculator and the engine speed. As discussed above, the air charge calculator 202 includes an adder 318. The output of the adder 318 is received at multiplier 332.

Multiplier 332 also indirectly receives input from the engine speed sensor and the firing frequency calculator 204. The output of the engine speed sensor is scaled (e.g., by multiplying the engine speed in RPM by 1/60) and the number of cylinders/2 which in the 4 stroke cycle example application is the maximum number of cylinders firing per revolution) in blocks 337 and 338. The scaled engine speed is an input to a multiplier 334.

Figure 4:
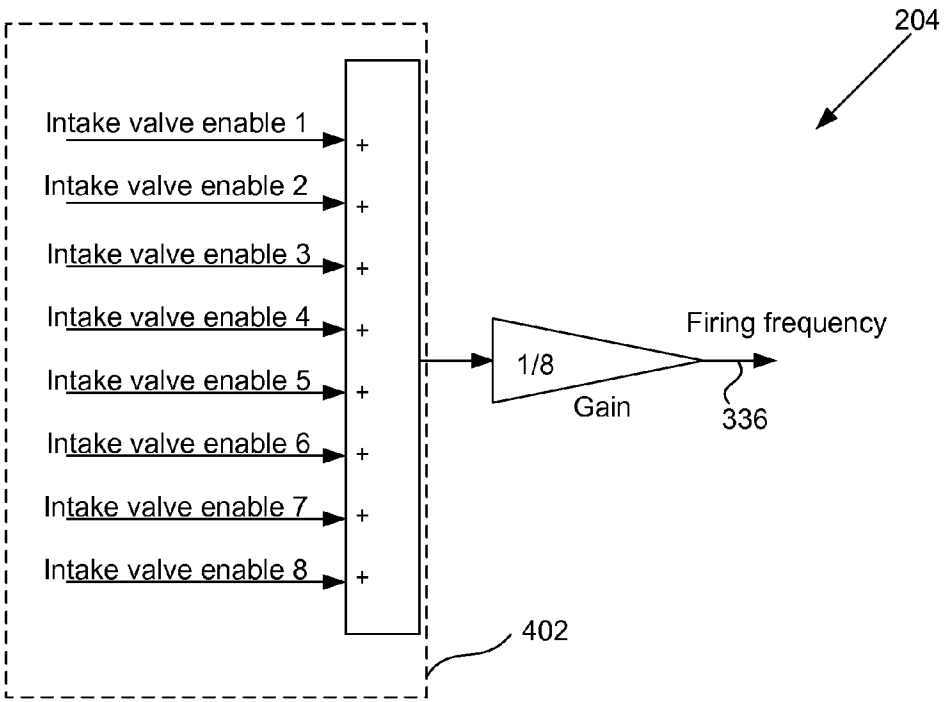
FIG. 4 is a diagram of the firing frequency calculator illustrated in FIG. 3.

The firing frequency 336 is also an input to multiplier 334. The firing frequency 336 is generated by the firing frequency calculator 204. An enlarged view of the firing counter 204 of FIG. 3 is shown in FIG. 4. The firing frequency calculator 204 includes a firing counter 402 that counts firing events within a firing window. The firing frequency 336 is calculated based on a firing window, which in the illustrated example involves eight prior firing opportunities. The operation (e.g., skip or fire) of all working chambers for each of its firing opportunities within the firing window is taken into account in the firing frequency calculation. Any suitable process may be used to calculate the firing frequency. In the illustrated embodiment, for example, the firing frequency calculator 204 is determined by summing bit values that indicate whether the intake valve for each working chamber has been activated (1) or deactivated (0) and multiplying the sum by 1/8 as would be the case for the 8 cylinder example illustrated. The illustrated embodiment uses an eight cylinder engine and the length of the window used to determine the firing frequency is set equal to the number of cylinders; however, this is not a requirement. The window may be adjusted for an engine having any number of cylinders or working chambers. The window may be longer or shorter than the number of cylinders in the engine.

It should be appreciated that the size of the firing window used in the firing frequency determination may vary widely. In the illustrated example, the firing window involves eight prior, consecutive firing opportunities and matches the number of working chambers in the engine. The number of firing opportunities in the firing window may be more or less, depending on operating conditions and other parameters, such as the size of the intake manifold.

Multiplier 334 multiplies the firing frequency 336 by the scaled output from the engine speed sensor. The output of multiplier 334 is an input to the multiplier 332. Multiplier 332 multiplies the output of multiplier 334 by the output of adder 318, which was referred to above. The output of multiplier 332 is scaled (e.g., multiplied by 273.15*the gas constant/the molecular weight of air) in block 339 to generate the first input 340 to the adder 330. Input 340 effectively indicates the rate at which the pressure volume contents of the manifold decreases due to firing of the cylinders.

The second input 342 to the adder 330 is based on input from the air flow measurement unit 206. Other methods for estimating air mass flow may also be used. In the illustrated embodiment, a mass air flow sensor indicates the mass air flow in grams per second or any suitable units. The air mass flow sensor may take many forms. The sensor may be a hot wire, ultrasonic, or vane type sensor. This signal is then converted to units of Pressure times Volume per second per Deg C. by multiplying by R (Universal Gas Constant) and dividing by the molecular weight of air at block 346. The scaled value is then multiplied at multiplier 348 with input from the mass air temperature (MAT) sensor or estimation. The resulting product is the second input 342 to the adder 330 in the MAP estimation unit 302. Input 342 indicates the rate of manifold pressure volume product change due to the amount of air flowing past the throttle which controls input flow to the intake manifold.

At the adder 330, the first input 340 is subtracted from the second input 342. This allows determination of the net rate of change in the amount of the manifold pressure volume product in the intake manifold. The result is divided by the volume of the intake manifold (block 344). The quotient is then integrated over time to provide an estimated manifold absolute pressure 310 (MAPHat) in suitable units, such as kilopascals. As previously discussed, the estimated manifold absolute pressure 310 is provided via a feedback loop to the air charge calculator 202 at the multiplier 316.

In the illustrated embodiment, the estimated mass air charge 324 is calculated using a particular combination of functional blocks, variables, units and mechanisms. It should be appreciated that any component of this combination can be altered, depending on the needs of a particular application. By way of example, the illustrated mass air charge determining unit 104 does not specifically account for gas that may be delivered into the intake manifold from a working chamber or an exhaust gas recirculation system. Additional functional blocks and/or mechanisms may be added to address these and any other factors that may affect the calculation of the mass air charge and the manifold absolute pressure.

In another example, the mass air charge determining unit 104 in FIG. 3 assumes that when a working chamber is skipped or deactivated, the air "pulse" that typically goes into a working chamber for combustion instead remains in the intake manifold. This normally contributes to an increase in the manifold absolute pressure. However, the present invention also contemplates implementations in which some or all of the skipped/deactivated working chambers draw in air during the intake phase. In such approaches, the mass air estimation unit 104 would be adjusted to take into account the impact of such air intake on the estimated MAP 310.

FIGS. 2-4 illustrate a firing frequency calculator, which takes into account a firing window of one or more firing opportunities. In many embodiments, this firing window refers to one or more past firing opportunities i.e., the firing frequency 336 helps indicate a historical pattern or number of firings/skips. However, some approaches contemplate using a future window. That is, the firing frequency can be derived from planned firing decisions that have not yet been acted upon for one or more future firing opportunities.

The figures refer to subcomponents and functional blocks that perform various functions. It should be appreciated that some of these subcomponents may be combined into a larger single component, or that a feature of one subcomponent may be transferred to another subcomponent. The present invention contemplates a wide variety of control methods and mechanisms for performing the operations described herein, and is not limited to what is expressly shown in the figures.

The described embodiments work well with dynamic skip fire engine operation. Dynamic skip fire engine operation generally involves directing firings such that at least one selected working cycle of at least one selected working chamber is activated and at least one selected working cycle of at least one selected working chamber is fired. Individual working chambers are sometimes deactivated and sometimes fired. In some embodiments, working chambers are fired under close to optimal conditions. That is, the throttle may be kept substantially open and/or held at a substantially fixed positioned and the desired torque output is met by varying the firing frequency. In some embodiments, during the firing of working chambers the throttle is positioned to maintain a manifold absolute pressure greater than 70, 80, 90 or 95 kPa. Dynamic skip fire engine operation, however, is not a requirement and the present invention may be applied to other types of engine control, such as a variable displacement control system.

The invention has been described primarily in the context of controlling the firing of 4-stroke piston engines suitable for use in motor vehicles. However, it should be appreciated that the described skip fire approaches are very well suited for use in a wide variety of internal combustion engines. These include engines for virtually any type of vehicle—including cars, trucks, boats, construction equipment, aircraft, motorcycles, scooters, etc.; and virtually any other application that involves the firing of working chambers and utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), radial engines, etc. It is also believed that the described approaches will work well with newly developed internal combustion engines regardless of whether they operate utilizing currently known, or later developed thermodynamic cycles. The described embodiments can be adjusted to work with engines having equally or unequally sized working chambers.

Some implementations of the present invention involve the use of an exhaust gas recirculation (EGR) system. That is, the described embodiments can be modified to take into account the exhaust mass flow input provided by the EGR system and the corresponding thermal effects. Models for estimating the effects of such inputs on the manifold intake pressure are known in the art and can be incorporated into the described embodiments and calculations.

While the invention has been described for cam actuated valves it is equally applicable to electromechanically actuated valves. This type of valve control allows more flexibility in the opening and closing of the intake and exhaust valves, since the valve timing is no longer constrained by a cam lobe phase and profile. In this case the intake and exhaust valve opening and closing timing can be tracked electronically and used to help estimate the mass air charge. The mass air charge is affected by the opening time of the intake valve and its opening relative to the intake stroke of the working chamber. The MAC may also be impacted by the exhaust valve opening and closing timing, since the amount of residual exhaust gas remaining in the working chamber varies with the exhaust valve timing.

Although only a few embodiments of the invention have been described in detail, it should be appreciated that the invention may be implemented in many other forms without departing from the spirit or scope of the invention. For example, although FIGS. 2 and 3 illustrate a specific set of mechanisms and modules for estimating the manifold absolute pressure and mass air charge, the present invention also contemplates other models that take into account a wide variety of other variables and parameters. Some implementations involve receiving input from additional sensors (e.g., a MAP sensor, an oxygen sensor, etc.) or take into account additional influences on the pressure in the intake manifold (e.g., releases of air from the working chamber into the intake manifold, the delivery of air from the intake manifold into a working chamber that will be skipped or deactivated, etc.) Although the described embodiments generally involve estimating the manifold absolute pressure to determine the mass air charge, the estimated MAP can be used for any purpose or operation that involves a MAP input or measurement. For example, the described embodiments can be used not only for engine/powertrain operation, but also for diagnostic purposes. Air mass flow may be determined by other means than a mass air flow sensor. It may be estimated from the throttle position and two pressure measurements, one on each side of the throttle. Therefore, the present embodiments should be considered illustrative and not restrictive and the invention is not to be limited to the details given herein.

What is claimed is:

1. An engine controller arranged to direct skip fire operation of an internal combustion engine having a plurality of working chambers and an intake manifold, the engine controller comprising:

a firing controller arranged to direct operation of the engine in a skip fire mode, the firing controller being arranged to direct a sequence of skip fire firings that delivers a desired engine output while operating at a first effective displacement, wherein during operation of the engine in the skip fire mode at the first effective displacement, a selected one of the working chambers will sometimes be skipped during a first firing opportunity of the selected working chamber and sometime be fired during an immediately following second firing opportunity of the selected working chamber; and a mass air charge determining unit that is arranged to, for each fired firing opportunity of the plurality of working chambers:

(i) determine a number of firings of all of the working chambers that will have taken place within a designated window corresponding to a fixed number of firing opportunities that immediately preceded such fired firing opportunity;

(ii) determine a firing ratio wherein the firing ratio is a ratio of firings to firing opportunities in the window with the ratio being fractionally less than or equal to 1; and (iii) estimate a mass air charge based on the firing ratio wherein the mass air charge estimation takes into account fluctuations of intake manifold pressure resulting from skipped firing opportunities; and cause fuel to be delivered to the working chamber associated with the fired firing opportunity for which the estimated mass air charge was determined based on the estimated mass air charge.

2. An engine controller as recited in claim 1 wherein a measurement of air flow into the intake manifold is used in the estimation of the mass air charge.

3. An engine controller as recited in claim 1 wherein:

the firing ratio is determined by the number of firing events in the firing window, and the firing window includes a number of firing opportunities equal to the number of working chambers that the internal combustion engine has.

4. An engine controller as recited in claim 1 wherein:

the mass air charge determining unit estimates a manifold absolute pressure; and the estimated mass air charge is calculated using the estimated manifold absolute pressure.

5. An engine controller as recited in claim 4, wherein the firing ratio will sometimes be different for different sequential fired firing opportunities during operation at the first effective displacement.

6. An engine controller as recited in claim 5 wherein:

the estimated manifold absolute pressure is based on at least one selected from the group consisting of the intake valve opening and closing timing, the engine speed, and the manifold air temperature; and the estimated mass air charge is calculated using the estimated manifold absolute pressure.

7. An engine controller as recited in claim 5 wherein the estimated mass air charge is calculated without input from a sensor that directly reads the pressure within an intake manifold.

8. An engine controller as recited in claim 1 wherein the estimated mass air charge is calculated on a firing opportunity by firing opportunity basis.

9. An engine controller as recited in claim 1 wherein the firing controller is arranged to direct firings in a skip fire manner such that at least one selected working cycle of at least one selected working chamber is deactivated and at least one selected working cycle of at least one selected working chamber is fired wherein individual working chambers are sometimes deactivated and sometimes fired.

10. An engine controller as recited in claim 1 wherein the firing window is used to help determine the firing ratio and the mass air charge, the firing window including one or more firing opportunities, each firing opportunity involving a skip or a fire, wherein a skip and a fire each have a different effect on a calculation of the estimated mass air charge.

11. An engine controller as recited in claim 1 wherein the mass air charge determining unit is further arranged to:

calculate a first amount of air that comes into the intake manifold based on input from a mass air flow sensor;

calculate a second amount of air that goes out of the intake manifold based on the firing ratio;

calculate an estimated manifold absolute pressure based on the first and second calculated amounts of air; and calculate the estimated mass air charge based on the estimated manifold absolute pressure.

12. An engine controller as recited in claim 1 wherein the working chambers are individually controlled and a firing decision is made for each individual working chamber in real time.

13. An engine controller arranged to direct skip fire operation of an internal combustion engine having a plurality of working chambers and an intake manifold, the engine controller comprising:

a firing controller arranged to direct operation of the engine in a skip fire mode, the firing controller being arranged to direct a sequence of skip fire firings that delivers a desired engine output while operating at a first effective displacement, wherein during operation of the engine in the skip fire mode at the first effective displacement, a selected one of the working chambers will sometimes be skipped during a first firing opportunity of the selected working chamber and sometime be fired during an immediately following firing opportunity of the selected working chamber; and a mass air charge determining unit that is arranged to, for each fired firing opportunity of the plurality of working chambers:

(i) count the number of firings that occur during a window of two or more firing opportunities of the plurality of working chambers that immediately preceded such fired firing opportunity;

(ii) calculate a firing ratio based at least in part on the number of counted firings and the number of firing opportunities in the window, the firing ratio being a ratio less than or equal to one, wherein the firing ratio will sometimes be different for different sequential fired firing opportunities during operation of the engine at the first effective displacement; and (iii) estimate a mass air charge based on the firing ratio which takes into account fluctuations of intake manifold pressure resulting from skipped firing opportunities, wherein the estimated mass air charge is calculated without input from a sensor that directly reads the pressure within an intake manifold.

14. An engine controller as recited in claim 13 wherein:

the mass air charge determining unit estimates a manifold absolute pressure; and the estimated mass air charge is calculated using the estimated manifold absolute pressure.

15. An engine controller as recited in claim 14 wherein the estimated manifold absolute pressure is based on a determination that a skip in the firing window contributes to a rise in the estimated manifold absolute pressure.

16. A method for control of an internal combustion engine having a plurality of working chambers during skip fire operation of the engine, wherein during skip fire operation of the engine at a first effective displacement, a selected one of the working chambers will sometimes be skipped during a first firing opportunity of the selected working chamber and sometime be fired during an immediately following firing opportunity of the selected working chamber, the method comprising:

measuring air flow into an intake manifold;

determining an intake valve timing;

determining an exhaust valve timing;

sensing an engine speed;

determining a manifold air temperature; and for each fired firing opportunity of the plurality of working chambers during the skip fire operation of the engine, (i) determining a number of firings that took place in a window of a plurality of firing opportunities that immediately preceded such fired firing opportunity;

(ii) calculating a firing ratio, wherein the firing ratio indicates a ratio of firings to firing opportunities in the window, the ratio being less than or equal to one; and (iii) calculating a mass air charge for such fired firing opportunity based at least in part on the measured air mass flow, the firing ratio, the engine speed, and the manifold air temperature wherein the calculation of the mass air charge takes into account fluctuations of intake manifold pressure resulting from skipped firing opportunities; and (iv) delivering fuel to such working chamber based on the calculated mass air charge.

17. A method as recited in claim 16 wherein calculating the firing ratio comprises determining the number of firings over an interval of firing opportunities.

18. A method as recited in claim 16 wherein a cam position is used to determine the intake valve timing and the exhaust valve timing.

19. A method as recited in claim 16 wherein an estimated manifold absolute pressure is determined as part of the mass air charge calculation.

20. An engine controller as recited in claim 13 wherein the firing ratio will sometimes be different for different sequential fired firing opportunities during operation of the engine at the first effective displacement.

21. An engine controller as recited in claim 20 wherein:

the mass air charge determining unit estimates a manifold absolute pressure; and the estimated mass air charge is calculated using the estimated manifold absolute pressure; and the estimation of the manifold absolute pressure is based on a determination that each firing decision made for the firing window that involves skipping a firing opportunity contributes to a rise in the estimated manifold absolute pressure.

* * * * *